US007461414B2

(12) United States Patent
Santa Cruz et al.

(10) Patent No.: US 7,461,414 B2
(45) Date of Patent: Dec. 9, 2008

(54) SIMPLIFIED BIDET ASSEMBLY FOR USE WITH A CONVENTIONAL TOILET

(76) Inventors: Cathy D. Santa Cruz, 7630 Tholl Dr., Reno, NV (US) 89506; Lloyd E. Stanley, 761 E. York Way, Sparks, NV (US) 89434

( * ) Notice: Subject to any disclaimer, the term of this patent is extended or adjusted under 35 U.S.C. 154(b) by 279 days.

(21) Appl. No.: 11/582,648

(22) Filed: Oct. 18, 2006

(65) Prior Publication Data

US 2008/0092283 A1 Apr. 24, 2008

(51) Int. Cl.
*A61H 35/00* (2006.01)

(52) U.S. Cl. ..... 4/420.4; 4/420.2; 4/448

(58) Field of Classification Search ..... 4/420.1, 4/420.2, 420.4, 443–448; 137/615, 616, 137/862

See application file for complete search history.

(56) References Cited

U.S. PATENT DOCUMENTS

| | | | | |
|---|---|---|---|---|
| 5,277,226 | A * | 1/1994 | Kuhlman | 137/862 |
| 5,987,659 | A * | 11/1999 | Cannizzaro | 4/420.2 |
| 6,105,179 | A * | 8/2000 | Burns | 4/420.4 |
| 6,357,057 | B1 * | 3/2002 | Krist | 4/420.4 |
| 7,013,502 | B2 * | 3/2006 | Pacheco | 4/420.2 |
| 2005/0120470 | A1 * | 6/2005 | Lim | 4/420.4 |

* cited by examiner

*Primary Examiner*—Tuan N Nguyen

(57) ABSTRACT

The invention is a bidet assembly that can be easily installed onto any existing conventional toilet. The bidet assembly provides enhanced ease of use, is ergonomically designed and aesthetically pleasing. Furthermore the bidet assembly may be formed from preexisting off the shelf items if desired. However, the bidet may also include optional features such as a specialized spray nozzle having a unique spray pattern, an ergonomically designed handgrip and novel shaped spray wand, etc.

12 Claims, 5 Drawing Sheets

SIMPLIFIED BIDET ASSEMBLY FOR USE WITH A CONVENTIONAL TOILET

FIELD OF THE INVENTION

The present invention relates in general to bidets but more particularly pertains to a bidet that is easily installed onto an existing conventional toilet. The bidet assembly provides enhanced ease of use, is ergonomically designed and aesthetically pleasing. Further taught herein is a method of installation and method of use.

BACKGROUND OF THE INVENTION

Toilets having built in bidets are well known, are currently available and are sold in a variety of shapes and sizes. Unfortunately, such toilets having built in bidets are extremely costly and the average consumer simply cannot afford to purchase one. As a result, retrofit bidets that can be installed onto an existing toilet have proven to be more desirable and again many varieties have been proposed within the known prior art.

Examples of the known prior art include U.S. Pat. Nos. 5,384,919, 5,960,484, 4,926,509, 6,167,577, 1,866,930 and 7,013,502. Within each of the noted references attempts have been proposed to teach a bidet that is usable with existing toilets. However, in each reference the bidets are attached onto the toilet seat and/or toilet bowl and are limited thereto. Also, such bidets require the user to position their privates over the spray nozzle and this can be very difficult and/or uncomfortable especially for individuals who are overly large, obese and/or disabled. Some bidets include a hand-held wand that allows a user to more accurately position the spray nozzle into the desired position. However, this type of wand as taught within the prior art has proven to be most inefficient as they are much too short in length. It is to be noted the length of the wand is especially important as a wand of proper length provides increased accuracy but more importantly allows a user to easily grasp the wand in a comfortable manner. Also, the user need not position their hand in between their legs and this proves to be most advantageous.

Still further, most bidets include a spray nozzle that is much to forceful resulting in splashing and making a mess that must be cleaned up after use. More importantly such spray nozzles are uncomfortable when used and can even be painful. This is especially important when used by individuals having medical conditions such as hemorrhoids, stitches after surgery, or the like. Also, the pre-existing spray nozzles do not spray in a specified preferred pattern as provided by the present invention.

Furthermore, prior art wands and spray nozzles are much too bulky and are not easily grasped especially by individuals having a weak grip due to hand disorders such as arthritis or carpal tunnel syndrome, etc.

OBJECTS AND ADVANTAGES

It is therefore an object of the present invention to provide an improved bidet that is both easy to use and inexpensive to manufacture. Is comprised of pre-existing parts that are easily attainable and more importantly can be easily installed onto any pre-existing water outlet associated with a toilet. However, the present invention includes a specific type of spray nozzle that provides new and unusual results heretofore not taught.

Yet another object of the present invention is to provide a new and improved bidet that includes a hand held wand that is ergonomically friendly and thus provides increased ease of use. More importantly the hand held wand is of a sufficient length to allow for large or obese individuals to easily maneuver the wand into the desired position without unnecessary bending and turning. This is also most advantageous for users who have limited mobility. For example, those individuals who may have neck or back injuries resulting in loss of twisting and turning of their body find the present bidet to be extremely useful.

Also a further object of the present bidet is when in use, the forearm and hand of the user are automatically ergonomically aligned, this is due to the unique angle of the spray nozzle and wand. Also, a very important object is that the user can easily adjust the wand and spray nozzle for either right or left hand use.

Yet another object of the present invention is to further include a bidet towel that can be used in combination with the wand or independently in a novel manner.

Still a further object of the present invention is to provide a bidet that allows for variable water pressure and volume within a safe comfortable range.

Another object of the present invention is to incorporate a means for mixing hot and cold input water with a resulting temperature within a controlled safe temperature range. As a result, the present bidet also incorporates optional means for including warm/cold water adjustment. For example, the bidet can be installed to include warm water from a sink attachment or from an optional water reserve canister. Whereby, if the tank is used, the water temperature is at least room temperature and/or or warmer. This is most advantageous as this provides a more regulated temperature and is most comfortable in use. Also, the reserve tank includes a receptacle for storage of the wand when not in use. Furthermore, when the wand is stored therein it is also subjected to the temperature of the tank and results in a wand that is warmer than when stored in a different location.

Still a further advantage and object of the present invention is that it proves to be most helpful for users who suffer from constipation. In use, the brain automatically associates the bidet with having a bowel movement. It is well known that the brain when subjected to an apparatus associated with an action results in automatic association. For example, a student while studying who always sits at a particular desk and/or location has greatly improved learning capabilities when compared to those who study at different locations and/or variable study areas. Thus, a user when subjected to use of the bidet over time trains the brain that it is time to defecate and truly improves regularity.

A further object of the present invention is to provide a bidet that may be used for medicinal purposes. For example, it was suggested by a Doctor that if a patient having hemorrhoids were to use the bidet with cool water for 30 minutes a day this could result in complete healing thereof and/or at least relieve much of the pain and discomfort. Patients have tried to use a shower nozzle but those available are much too forceful and tend to increase pain. This is why the present nozzle of the bidet is most advantageous and provides new and unusual end results.

Still another object of the present invention is to provide a bidet wherein the wand may also be used for cleansing of the toilet bowl, such as when one has an accident or the like.

Yet a further object of the present invention is to incorporate a one-way check valve to prevent water back flow.

Also a further object of the present invention is to provide method steps for installing the bidet that are simple and easy to follow and require very little time.

Still another object of the present invention is to provide a bidet that is not attached onto the toilet or water closet and is easily stored on the wall adjacent thereto when not in use.

Other objects and advantages will be seen when taken into consideration with the following drawings and specification.

DETAILED DESCRIPTION OF THE DRAWINGS

Referring now in detail to the drawings wherein like characters refer to like elements throughout the various views. The present invention is a new, improved and simplified bidet represented by overview (10) depicted in FIG. 1. The bidet is packaged, pre-assembled and ready for installation when purchased by the end consumer. The bidet is easily installed onto any pre-existing water outlet (12) typically associated with a pre-existing toilet (14) or the like. It is to be understood any suitable type of pre-existing toilet may be easily used in combination with the present bidet. As will be seen within the later defined installation method.

Figure 2:
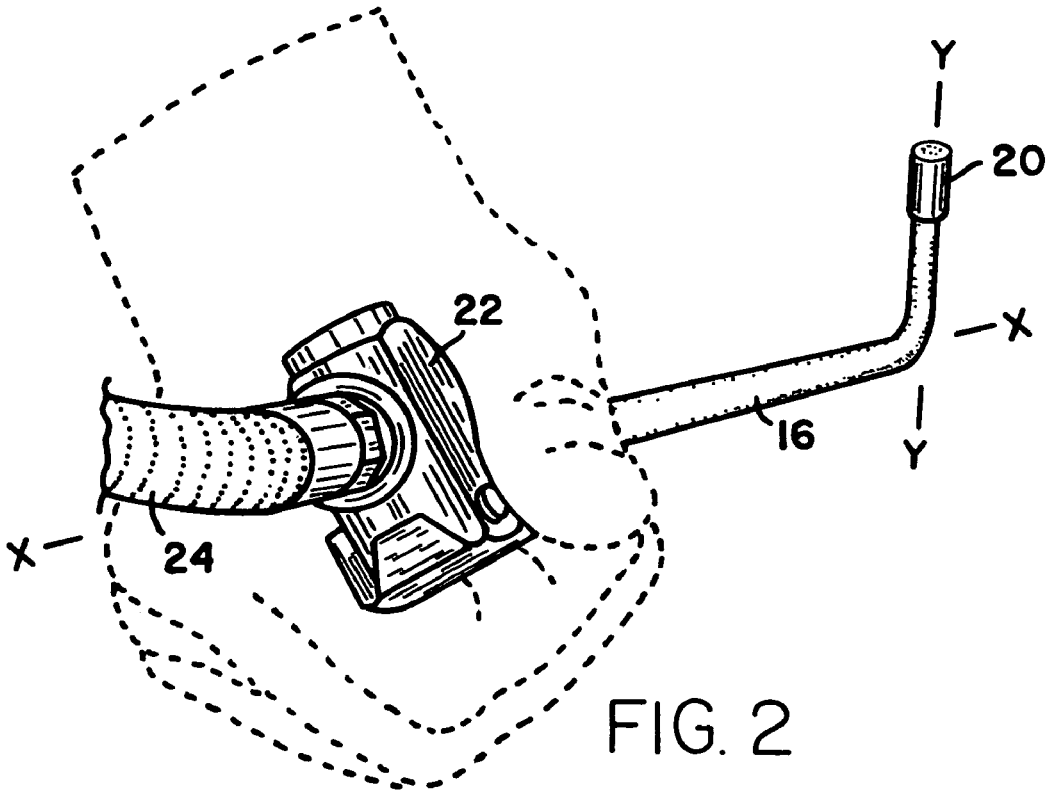
FIG. 2 is substantially an enlarged perspective view of the hand-held wand including the on/off hand operated valve and also depicting the ergonomic alignment of the hand and wand when in use.

The general construction for the present bidet assembly includes an elongated water delivery tube (16) (or wand) having a first end (16-A), a second end (16-B), a Y-axis, an X-axis shown in FIG. 2, an internal fluid passage (18) and a length. It is to be noted that the length of the wand is dependant upon engineering choice. However, it is advantageous for shipping purposes to be of a length that is approximately 13½ inches to comply with standard shipping boxes provided by the postal service. The first end (16-A) being bent upwardly and outwardly (when compared to the on/off lever 22, respectively) at an angle relative to the Y-axis and the X-axis. For example, in FIG. 2 the preferred embodiment is more clearly shown and depicts more accurately the angle of preference which is at a 65-degree angle, respectively. As can be seen therein and also within FIG. 7 the first end (16-A) is attached onto a spray nozzle (20) and the second end (16-B) is attached onto a hand actuated on/off fluid lever (22) that is in open communication with the internal fluid passage (18) for controllably directing a fluid when in an open position from within the hand actuated on/off fluid lever (22) into the internal fluid passage (18) and then forcibly directs the fluid into the spray nozzle (20) and outwardly there from. When the hand actuated on/off fluid lever (22) is in an off position the fluid is not directed into the internal fluid passage.

Figure 7:
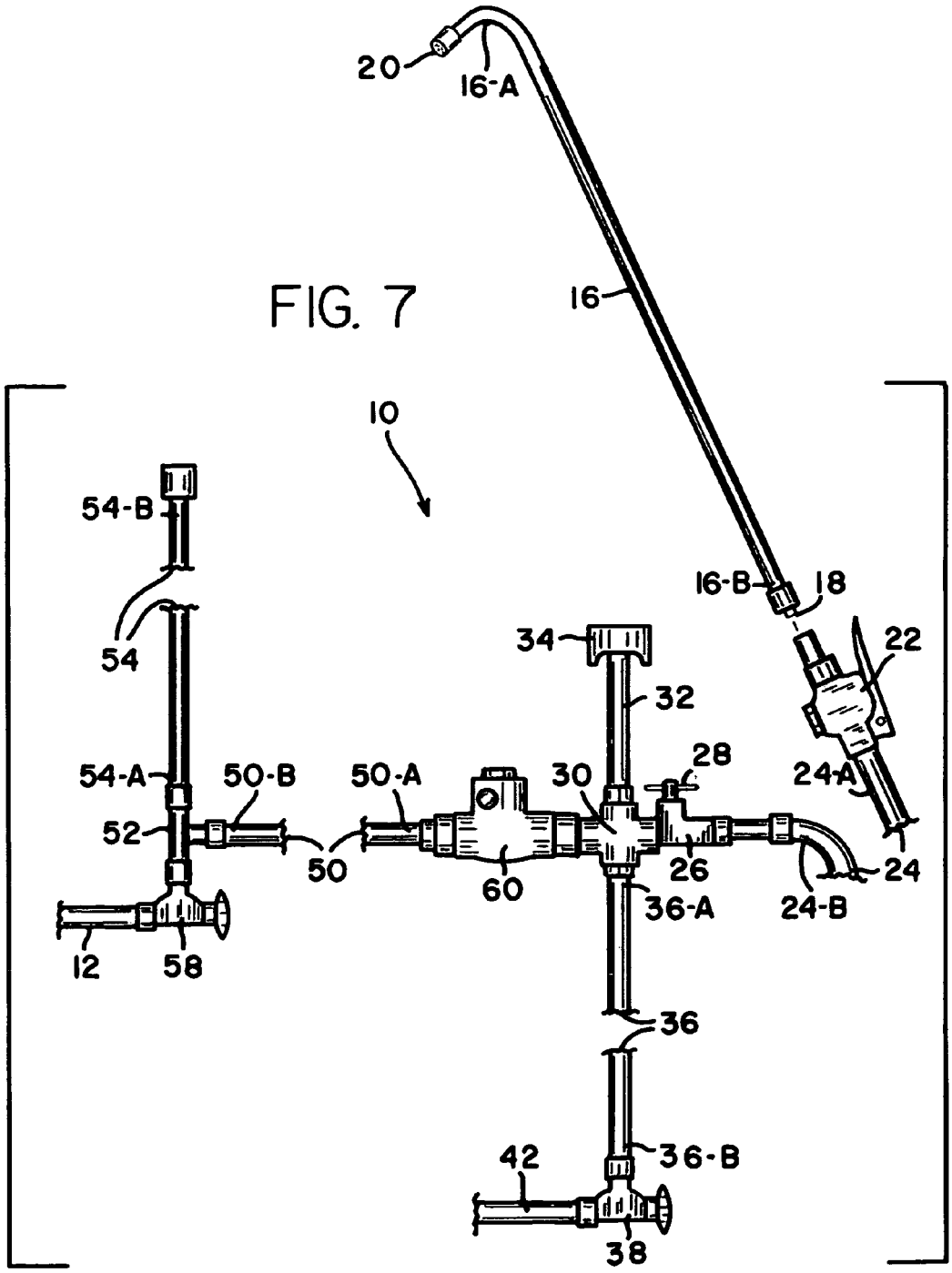
FIG. 7 is a plan view depicting the major components of the preferred embodiment.

Referring now to FIG. 7 wherein all of the standard components are more clearly depicted. Whereby the bidet further includes a first hose (24) having a first end (24-A) and a second end (24-B). As can be seen the hand actuated on/off fluid lever (22) is interconnected onto the first end (24-A) of the first hose (24) for receiving fluid there from. The second end (24-B) of the first hose (24) is attached onto a fluid flow-metering valve (26) having an adjustable fluid regulating means (28) thereon for regulating the quantity of fluid that is directed there from into the first fluid hose (24). Further included is a fluid diverter pipe fitting (30) having at least three directional ports. The fluid flow metering valve (26) being interconnected onto one of the three directional ports for receiving the fluid there from.

As further depicted in FIG. 7, the bidet includes a second hose (32) having a first end and a second end and a toilet tank connector fitting (34). The first end of the second hose (32) is attached onto one of the three directional ports and the second end of the second hose (32) is attached onto the toilet tank connector fitting (34). Further included is a third hose (36) having a first end (36-A) and a second end (36-B). The first end (36-A) of the third hose (36) is attached onto one of the three directional ports and the second end (36-B) of the third hose (36) is attached onto a water outlet angle stop fitting (38) and the water outlet angle stop fitting (38) is attached onto the water outlet (42) and the water outlet (42) supply's the fluid thereto, namely water.

It can now be seen while in operation when a user flushes the toilet (14) the fluid is directed from the water outlet (42), into the water outlet angle stop fitting (38), into the third hose (36), into the fluid diverter pipe fitting (30), into the second hose (32), into the toilet tank connector fitting (34), into the toilet tank (15). The fluid is also directed into the fluid flow-metering valve (26) and into the first hose (32). However, while the toilet tank (15) is filling and when the user simultaneously actuates the hand actuated on/off lever (22) into an open/on position, the fluid from the first hose (32) is then diverted into the hand actuated on/off lever and into and throughout the elongated water delivery tube (16) and dispersed from said spray nozzle (20), thus resulting in a less pressurized cool first spray wash that is gentle. Thereafter when the toilet tank (15) is refilled and the on/off lever is still in the open/on position, the fluid is only diverted throughout the elongated water delivery tube (16) and dispersed from the spray nozzle (20), thus resulting in a more pressurized cool second spray wash.

It is to be understood the above method of use is preferred as the reduced initial pressure helps to also reduce "splash" occurring within the toilet bowl. If the initial pressure were not reduced, this could result in waste from within the toilet bowl being forcibly directed upwards and outwards from therein, this possibly resulting in a mess. However, it is to be clearly understood that the user can easily adjust the fluid pressure to their individual liking. This is accomplished by adjustably varying the fluid regulating means (28) associated with fluid flow metering valve (26). In actual use, the applicants have found that this is most advantageous because when used in different regions of the world, the temperature and pressure of the incoming water is extremely variable. Whereby, the user's each have a personalized preferred pressure and the fluid flow-metering valve (26) resolves this issue in a simplified easy to adjust manner.

It is to be further understood that if the user does not wish to flush the toilet first, the user may adjust the fluid regulating means (28) of the fluid flow-metering valve (26) to a low pressure setting and upon actuation of the hand actuated on/off lever (22) into an open/on position, a cool refreshing spray is provided. Thereafter, if the user readjusts the fluid regulating means (28) of the fluid flow-metering valve (26) to a medium or high-pressure setting, then a more pressurized spray wash is provided. Therefore, the present bidet is completely adjustable and can be easily used by individuals having different needs and/or likes.

Figure 4:
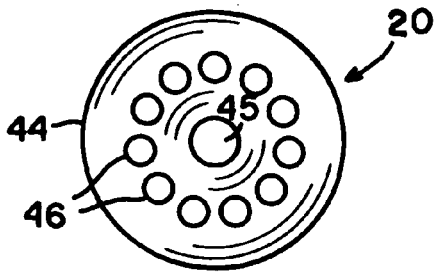
FIG. 4 is an end view of the nozzle depicting spray apertures.
Figure 5:
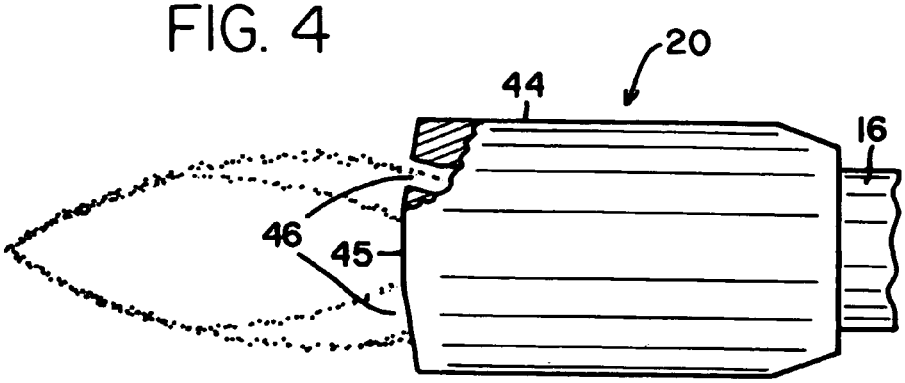
FIG. 5 is a side view of the nozzle including a partial cut-a-way depicting spray pattern.
Figure 6:
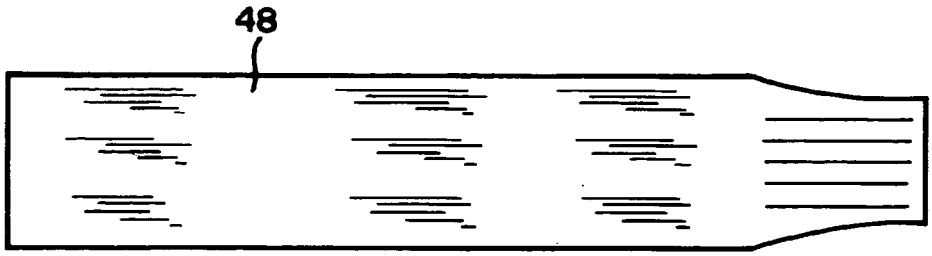
FIG. 6 is a side view of a bidet towel.

The bidet assembly of the present invention further includes a specialized spray nozzle (20) depicted in FIGS. 4 & 5 that is most efficient and provides a novel spray pattern. The spray nozzle (20) being formed from a circular housing (44) having an attachment end (44-A) for frictionally receiving the first end (16-A) of elongated water delivery tube (16) therein. The circular housing (44) having an end section having multiple apertures (45 & 46) there through. The multiple apertures including a first enlarged centralized aperture (45) and numerous equally spaced apart apertures (46) that are distanced outwardly in a circular pattern from the enlarged centralized aperture (45) and the numerous equally spaced apart apertures (46) each being cut at a 10 degree angle outwardly from the enlarged centralized aperture (45). As a result, when the fluid is directed there through, a unique spray pattern is provided wherein the enlarged centralized aperture (45) sprays directly at a target area and the numerous equally spaced apart apertures (46) spraying evenly around the target area when the nozzle (20) is positioned in close proximity to the target area. However, when the nozzle (20) is positioned farther away from the target area the enlarged centralized aperture (45) and the numerous equally spaced apart apertures (46) converge thus spraying in a direct pattern at the distanced target area because the enlarged centralized aperture creates a vortex effect and this simultaneously provides aeration as well. An example of the spray pattern is depicted within FIG. 5. This is most advantageous as this allows the user to direct the spray pattern at the target area for thorough cleansing and/or the user may prefer cleansing the surrounding area as well.

Referring now the preferred embodiment for the wand, namely, elongated water delivery tube (16) and the on/off lever (22). It is to be noted that the shape and length of the wand or elongated water delivery tube (22) is extremely important as it facilitates ease of use. For example, the shape is important as when the on/off lever (22) is properly held by the user, the wand (16) (because of the novel bend and length) eliminates stressful bending and awkward movements by the user, as it is easily, automatically and perfectly aligned with the target area when held properly. For reference see FIG. 2.

Another important advantage of the present on/off fluid lever (22) is that it can be variably adjusted between a first position and a second position. The first position (as depicted herein) is suitable for use by a right-handed user. If however, a left-handed user wishes to align the lever ergonomically, they simply loosen the nut, turn the lever in the opposite direction until adjusted and then tighten the nut, thus assuming the second position that is suitable for use by a left-handed user. Most importantly, the on/off fluid lever (22) when in use provides proper ergonomic alignment between the hand, wrist and forearm of a user as can be seen within FIG. 2.

Fore ease and convenience, the wand, namely, elongated water delivery tube (16) of the present bidet may be used in combination with a bidet towel (48). In use "after cleansing with the bidet" the user may wish to dry or blot them selves with the bidet towel. It is to be understood that this is not necessary as an "air dry" is suitable. However, if the bidet towel (48) is desired, it is so constructed as to simply slide onto the wand, namely, elongated water delivery tube (16) with nozzle (20) and then wiping or blotting can commence such as depicted in FIG. 7. In the preferred embodiment, the bidet towel (48) is made from a terry cloth material and is basically in the form of a tubular sock having a length of approximately 14-20 inches. In use, it has been found that the bidet towel (48) is most comfortable, efficient and can be used repeatedly as it does not become soiled in most cases. Therefore, after use the user can easily hang the bidet towel on a shower door or any other convenient location until needed again. As an alternative, if the user does wish to use the bidet towel but they don't want to position it on the wand it can easily be used by itself. Due the shape and size of the bidet towel it can easily be grasped with one hand then the other end positioned between your legs and grasped by the second hand. Then upon standing you can dry in the same manner as when drying between your legs with a towel after a shower, or the like.

The bidet assembly of the present invention includes an optional warm water attachment assembly as depicted in FIG. 7 and may be easily incorporated if desired. As exemplified herein, the fluid diverter pipe fitting (30) provides a fourth directional port that is attachable onto a first end (50-A) of a warm water connector hose (50) and the warm water connector hose has a second end (50-B) that is attachable onto a connector tee fitting (52). The connector tee fitting (52) has a first fluid flow directional port and a second fluid flow directional port. The first fluid flow directional port being attachable onto a first end (54-A) of a fourth hose (54) and the second end (54-B) of the fourth hose (54) being attachable onto a sink faucet assembly (not shown). It is to be noted the hose bibs (not defined) and the sink faucet assembly (not shown) are each standard components associated with hoses and/or sink assemblies. Thus their workings are not taught herein. The second fluid flow directional port of the connector tee fitting (52) is attachable onto a hot water angle stop fitting (58) and the hot water angle stop fitting (58) is attachable onto a standard hot water outlet (not shown). Thus the warm water attachment assembly delivers warm water to the fluid diverter pipe fitting (30) wherein warm water and cool water can be adjustably mixed accordingly.

Although the above warm water attachment assembly is suitable for use alone, it may be an advantage to further include a fluid restriction apparatus so as to eliminate the possibility of any cold water being directed into the hot water system. If this is needed then the fourth directional port that is attachable onto the first end (50-A) of the warm water connector hose (50) are interconnected via a one way check valve (60) that allows warm water to flow into the fourth directional port but does not allow cold fluid to enter into the warm water connector hose (50).

It is to be understood that the above optional warm water assembly is easy to install and is very efficient but it does require some modifications of the existing installation, such as it may require a hole in the wall and/or in the sink cabinetry. Therefore, in certain situations it may not be appropriate and/or allowed to modify the existing installation. For example, some homeowners, renters or apartment occupants may not wish to install the system as taught above. With this in mind the applicants also provide an optional warm water installation method as follows.

Figure 8:
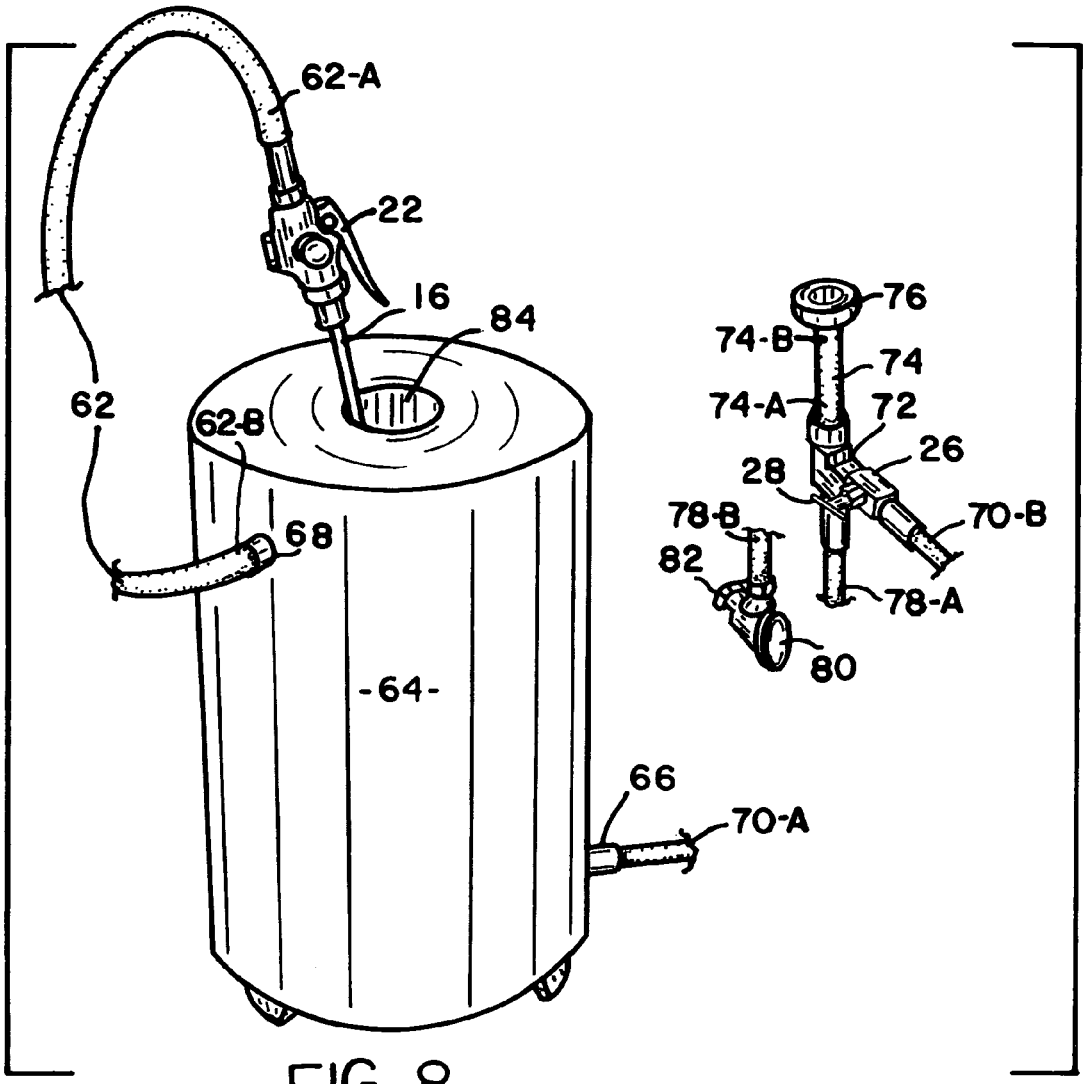
FIG. 8 is a plan view depicting an alternative water reserve canister.

For example, as further depicted in FIG. 8, this embodiment differs slightly as it includes a first hose (62) having a first end (62-A) and a second end (62-B). The hand actuated on/off fluid lever (22) is interconnected onto the first end (62-A) of the first hose (62) for receiving fluid there from. This embodiment further includes a water reserve canister (64) having a water inlet (66) at a lower section thereof and a water outlet (68) at an upper section thereof. The second end (62-B) of said first hose (62) being attached onto the water outlet (68) at an upper section. Further provided is a water reserve canister hose (70) having a first end (70-A) and a second end (70-B). The first end (70-A) of the water reserve canister hose (70) being attached onto the water inlet (66) at a lower section and the second end (70-B) of the water reserve canister hose (70) being attached onto a fluid flow metering valve (26) having an adjustable fluid regulating means (28) thereon for regulating the quantity of fluid that is directed there from into the water reserve canister hose (70). Also included is a fluid diverter pipe fitting (72) having at least three directional ports. The fluid flow metering valve (26) being interconnected onto one of the three directional ports for receiving the fluid there from. Also included is a second hose (74) having a first end (74-A) and a second end (74-B) and a toilet tank connector fitting (76). The first end (74-A) of the second hose (74) being attached onto one of the three directional ports and the second end (74-B) of the second hose (74) being attached onto the toilet tank connector fitting (76). Also included is a third hose (78) having a first end (78-A) and a second end (78-B). The first end (78-A) of the third hose (78) being attached onto one of the three directional ports and the second end (78-B) of the third hose (78) being attached onto a water outlet angle stop fitting (80) and said angle stop fitting (80) being attached onto the water outlet (82) and said water outlet (82) supplying the fluid.

Referring now to the water reserve canister (64), which further includes therein an elongated receptacle (84) for slidably receiving the elongated water delivery tube (16) therein for storage thereof when not in use. It is to be understood the elongated receptacle (84) is open at the top and bottom and allows for air circulation there through. However, the top section of receptacle (84) is large enough to slidably receive the elongated water delivery tube (16) therein yet the bottom section is smaller so that the elongated water delivery tube (16) cannot fall out the bottom.

It is to be understood the last described embodiment as depicted in FIG. 8 is most advantageous as this not only eliminates the need for modifications during installation, but also further provides additional advantages. For example, as clearly seen in FIG. 8, the canister (64) is mounted on support legs and this allows for air circulation under the canister (64) and also within the elongated receptacle (84). Whereby as a result, due to convection, the water within the canister (64) is warmer at the top and cooler at the bottom. Therefore, being the water outlet (68) is located at the top, warmer water is automatically delivered into the elongated water delivery tube (16) and is of a temperature that is most comfortable for use on the sensitive tissues associated with the target area. Thus, resulting in new and unusual advantages not heretofore available and/or taught within the known prior art.

Figure 3:
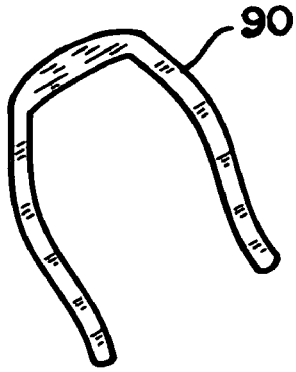
FIG. 3 is a side view of an optional ergonomic handgrip.

The present bidet is fully functional and complete as described heretofore. However, additional optional features are included as accessories of choice. For example as previously noted, it is advantageous to include an ergonomically designed handgrip (90) that is mountable onto the on/off lever (22). It is to be understood that the on/off lever (22) may be molded into the desired ergonomic design at the point of manufacture if so desired to include appropriate finger/thumb/palm indentations that provide comfort. Although not shown herein this is to be included. Or if preferred the bidet may be sold with an optional ergonomically designed handgrip (90) that is made from a flexible material of engineering choice, such as soft rubber or the like. See FIG. 3 wherein the preferred embodiment for the ergonomically designed handgrip (90) is clearly depicted. Wherein, the ergonomically designed handgrip (90) is molded into a shape that is most comfortable and the ergonomically designed handgrip (90) can be easily slidably or frictionally engaged onto the on/off lever (22).

Figure 1:
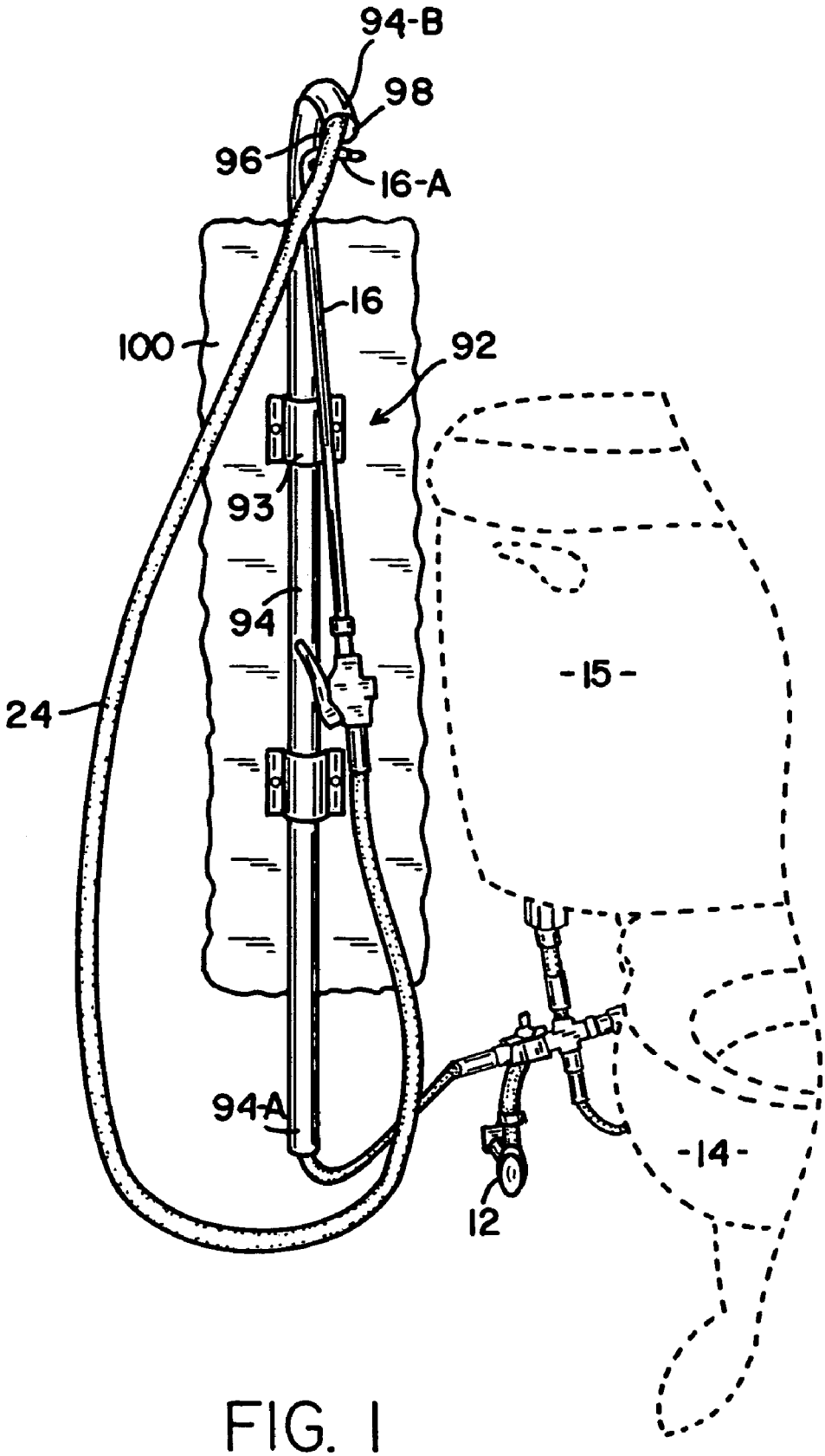
FIG. 1 is substantially an overview of the present bidet when assembled and installed onto a pre-existing water inlet associated with a toilet.

The bidet of the present invention further includes as an optional feature a wand support structure (92) for supporting the wand (16) thereon when not in use that is mounted in close proximity to said toilet. It is to be understood the wand support structure can simply be a hook mounted on a wall, or the like. Or as preferred by the applicants it can be more complex comprising of the following components as depicted in FIG. 1. Namely, an elongated tubular structure (94) having a first end (94-A) and a second end (94-B) that is curved downwardly. It is to be understood that the elongated tubular structure (94) can be easily mounted onto a wall (100) or the like, by any suitable mounting means of engineering choice, such as by support brackets (93) or the like. The second end (94-B) further includes a hook member (96) that is functional for supporting the first end (16-A) of the wand (16) thereon when not in use. The elongated tubular structure (94) provides an internal passage (98) that is of a shape and size to slidably receive and support the first hose (24) there through. Whereby, when the wand (16) is not in use, it is aesthetically supported on an attachment surface such as onto wall (100). However, when the bidet is needed, it is easily removed/retrieved from the hook member (96) and the first hose (24) allows for easy mobility in a most convenient efficient manner.

It can now be seen we have herein provided an improved bidet assembly that is economical and cost effective to produce and is simplified in assembly and installation. It is usable for use with any pre-existing toilet, is ergonomically friendly and provides ease of use that heretofore was not attainable.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. A bidet assembly for use with a water outlet associated with a toilet or bathroom installation, said bidet assembly comprising: an elongated water delivery tube having a first end, a second end, a Y-axis, an X-axis, an internal fluid passage and a length, said first end being bent upwardly and outwardly at an angle relative to said Y-axis and said X-axis, said first end being attached onto a spray nozzle, said second end being attached onto a hand actuated on/off fluid lever that is in open communication with said internal fluid passage for controllably directing a fluid when in an open position from within said hand actuated on/off fluid lever into said internal fluid passage and then forcibly directs said fluid into said spray nozzle and outwardly there from, when said hand actuated on/off fluid lever is in an off position said fluid is not directed into said internal fluid passage, a first hose having a first end and a second end, said hand actuated on/off fluid lever being interconnected onto said first end of said first hose for receiving said fluid there from, said second end of said first hose being attached onto a fluid flow metering valve having an adjustable fluid regulating means thereon for regulating the quantity of said fluid that is directed there from into said first fluid hose, a fluid diverter pipe fitting having at least three directional ports, said fluid flow metering valve being interconnected onto one of said three directional ports for receiving said fluid there from, a second hose having a first end and a second end, a toilet tank connector fitting, said first end of said second hose being attached onto one of said three directional ports, said second end of said second hose being attached onto said toilet tank connector fitting, a third hose having a first end and a second end, said first end of said third hose being attached onto one of said three directional ports, said second end of said third hose being attached onto a water outlet angle stop fitting and said water outlet angle stop fitting being attached onto said water outlet, and said water outlet supplying said fluid, whereby:

in operation when a user flushes the toilet, said fluid is directed into the toilet tank, while said toilet tank is filling and said user simultaneously actuates said hand actuated on/off lever into said open position, said fluid from said water outlet is also diverted throughout said elongated water delivery tube and dispersed from said spray nozzle, thus resulting in a less pressurized cool first spray wash that is gentle, thereafter when said toilet tank is refilled and said on/off lever is still in said open position, said fluid is only diverted throughout said elongated water delivery tube and dispersed from said spray nozzle, thus resulting in a more pressurized cool second spray wash.

2. The bidet assembly of claim 1 wherein said spray nozzle comprising: a circular housing having an attachment end for receiving said first end of said elongated water delivery tube therein, said circular housing having an end section, said end section having multiple apertures there through, said multiple apertures including a first centralized aperture and numerous equally spaced apart apertures that are distanced outwardly in a circular pattern from said centralized aperture and said numerous equally spaced apart apertures each being cut at a 10 degree angle outwardly from said centralized aperture, whereby:

when said fluid is directed there through, a unique spray pattern is provided wherein said centralized aperture sprays directly at a target area with said numerous equally spaced apart apertures spraying evenly around said target area when said nozzle is positioned in close proximity to said target area, however when said nozzle is positioned farther away from said target area said centralized aperture and said numerous equally spaced apart apertures converge thus spraying in a direct pattern at the distanced target area because said centralized aperture creates a vortex effect and this simultaneously provides aeration as well.

3. The bidet assembly of claim 1 wherein said on/off fluid lever is variably adjustable between a first position and a second position, said first position is suitable for use by a right-handed user and said second position is suitable for use by a left-handed user.

4. The bidet assembly of claim 1 wherein said on/off fluid lever when in use provides proper ergonomic alignment between the hand, wrist and forearm of a user.

5. The bidet assembly of claim 1 further includes a bidet towel that is removably attachable onto said elongated water delivery tube and said spray nozzle.

6. The bidet assembly of claim 1 includes an optional warm water attachment assembly comprising: said fluid diverter pipe fitting having a fourth directional port that is attachable onto a first end of a warm water connector hose, said warm water connector hose having a second end that is attachable onto a connector tee fitting, said connector tee fitting having a first fluid flow directional port and a second fluid flow directional port, said first fluid flow directional port being attachable onto a first end of a fourth hose, said second end of said fourth hose being attachable onto a hose connector for attaching said fourth hose onto a sink faucet assembly, said second fluid flow directional port of said connector tee fitting being attachable onto a hot water angle stop fitting and said hot water angle stop fitting being attachable onto a hot water outlet, thus said warm water attachment assembly delivers warm water to said fluid diverter pipe fitting.

7. The bidet assembly of claim 6 wherein said fourth directional port that is attachable onto a first end of a warm water connector hose are interconnected via a one way check valve, and said one way check valve allows warm water to flow into said fourth directional port but does not allow said fluid to enter into said warm water connector hose.

8. The bidet assembly of claim 1 wherein said first end being bent upwardly and outwardly at an angle relative to said Y-axis and said X-axis is a 65 degree angle.

9. The bidet assembly of claim 1 further includes as an optional feature a wand support structure for supporting the wand thereon when not in use that is mounted in close proximity to said toilet.

10. The bidet assembly of claim 1 further includes as an optional feature an ergonomically designed handgrip that is mountable onto said on/off lever.

11. A bidet assembly for use with a water outlet valve associated with a toilet or bathroom installation, said bidet assembly comprising: an elongated water delivery tube having a first end, a second end, a Y-axis, an X-axis, an internal fluid passage and a length, said first end being bent upwardly and outwardly at an angle relative to said Y-axis and said X-axis, said first end being attached onto a spray nozzle, said second end being attached onto a hand actuated on/off fluid lever that is in open communication with said internal fluid passage for controllably directing a fluid when in an open position from within said hand actuated on/off fluid lever into said internal fluid passage and then forcibly directs said fluid into said spray nozzle and outwardly there from, when said hand actuated on/off fluid lever is in an off position said fluid is not directed into said internal fluid passage, a first hose having a first end and a second end, said hand actuated on/off fluid lever being interconnected onto said first end of said first hose for receiving said fluid there from, a water reserve canister having a water inlet at a lower section thereof, and a water outlet at an upper section thereof, said second end of said first hose being attached onto said water outlet at an upper section, a water reserve canister hose having a first end and a second end, said first end of said water reserve canister hose being attached onto said water inlet at a lower section, said second end of said water reserve canister hose being attached onto a fluid flow metering valve having an adjustable fluid regulating means thereon for regulating the quantity of said fluid that is directed there from into said water reserve canister hose, a fluid diverter pipe fitting having at least three directional ports, said fluid flow metering valve being interconnected onto one of said three directional ports for receiving said fluid there from, a second hose having a first end and a second end, a toilet tank connector fitting, said first end of said second hose being attached onto one of said three directional ports, said second end of said second hose being attached onto said toilet tank connector fitting, a third hose having a first end and a second end, said first end of said third hose being attached onto one of said three directional ports, said second end of said third hose being attached onto a water outlet angle stop fitting, said angle stop fitting being attached onto the water outlet and said water outlet supplying said fluid.

12. The bidet assembly for use with a water outlet valve associated with a toilet or bathroom installation of claim 11 wherein said water reserve canister further includes therein an elongated receptacle for slidably receiving said elongated water delivery tube therein for storage thereof when not in use.

* * * * *